US008654983B2

(12) United States Patent
Breebaart

(10) Patent No.: US 8,654,983 B2
(45) Date of Patent: Feb. 18, 2014

(54) AUDIO CODING

(75) Inventor: Dirk Jeroen Breebaart, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 1742 days.

(21) Appl. No.: 12/066,509

(22) PCT Filed: Aug. 31, 2006

(86) PCT No.: PCT/IB2006/053040
§ 371 (c)(1),
(2), (4) Date: Mar. 12, 2008

(87) PCT Pub. No.: WO2007/031896
PCT Pub. Date: Mar. 22, 2007

(65) Prior Publication Data

US 2008/0205658 A1 Aug. 28, 2008

(30) Foreign Application Priority Data

Sep. 13, 2005 (EP) ..... 05108405
Feb. 21, 2006 (EP) ..... 06110231

(51) Int. Cl.
*H04R 5/00* (2006.01)

(52) U.S. Cl.
USPC ..... 381/17

(58) Field of Classification Search
USPC ..... 381/17
See application file for complete search history.

(56) References Cited

U.S. PATENT DOCUMENTS

2003/0035553 A1 2/2003 Baumgarte et al.
2006/0045274 A1 * 3/2006 Aarts et al. ..... 381/17

FOREIGN PATENT DOCUMENTS

WO W02004028204 A2 4/2004

OTHER PUBLICATIONS

Herre et al: "The Reference Model Architecture for MPEG Spatial Audio Coding"; Audio Engineering Society Convention Paper 6447, May 28, 2005, pp. 1-13.
Engdegard et al: "Synthetic Ambience in Parametric Stereo Coding"; Audio Engineering Society Convention Paper 6074, May 8, 2004, pp. 1-12.
Herre et al: "MP3 Surround: Efficient and Compatible Coding of Multi-Channel Audio"; Audio Engineering Society Convention Paper 6049, 116th Convention,May 8-11, 2004, pp. 1-14.
Baumgarte et al: "Binaural Cue Coding-Part1: Psychoacoustic Fundamentals and Design Principles"; IEEE Transactions on Speech and Audio Processing, vol. 11, No. 6, pp. 509-519, Nov. 2003.
Faller et al: "Binaural Cue Coding-Part II: Schemes and Applications"; IEEE Transactions on Speech and Audio Processing, Vo. 11, No. 6, pp. 520-531, Nov. 2003.

* cited by examiner

*Primary Examiner* — Fernando L Toledo
*Assistant Examiner* — Neil Prasad

(57) ABSTRACT

A spatial decoder unit (23) is arranged for transforming one or more audio channels (s; l, r) into a pair of bin-aural output channels (lb, rb). The device comprises a parameter conversion unit (234) for converting the spatial parameters (sp) into binaural parameters (bp) containing binaural information. The device additionally comprises a spatial synthesis unit (232) for transforming the audio channels (L, R) into a pair of binaural signals (Lb, Rb) while using the binaural parameters (bp). The spatial synthesis unit (232) preferably operates in a transform domain, such as the QMF domain.

14 Claims, 6 Drawing Sheets

AUDIO CODING

Figure 1:
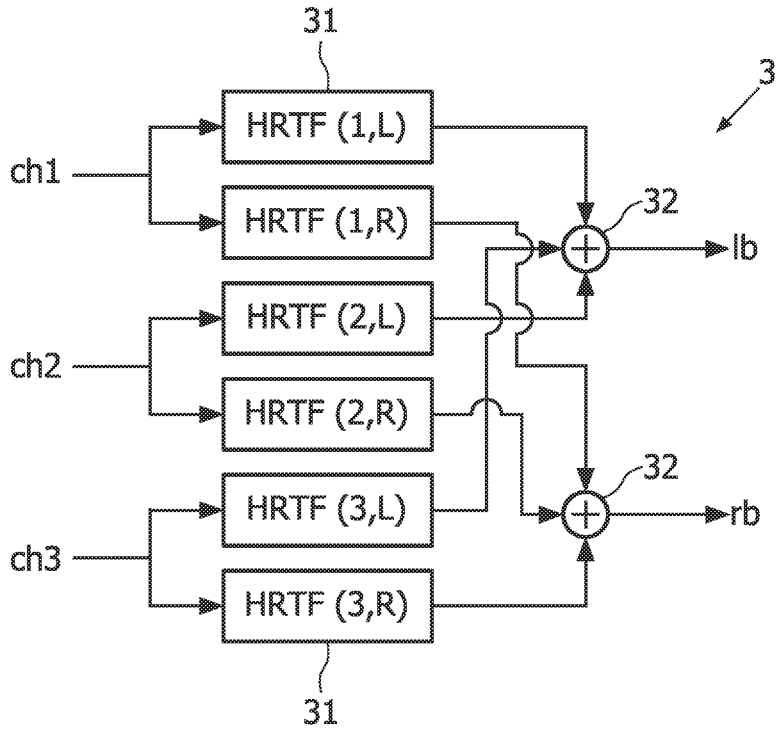
FIG. 1 Prior Art

The present invention relates to audio coding. More in particular, the present invention relates to a device for and a method of converting an audio input signal into a binaural output signal, wherein the input signal comprises at least one audio channel and parameters representing additional channels.

It is well known to record and reproduce binaural audio signals, that is, audio signals which contain specific directional information to which the human ear is sensitive. Binaural recordings are typically made using two microphones mounted in a dummy human head, so that the recorded sound corresponds to the sound captured by the human ear and includes any influences due to the shape of the head and the ears. Binaural recordings differ from stereo (that is, stereophonic) recordings in that the reproduction of a binaural recording requires a headset, whereas a stereo recording is made for reproduction by loudspeakers. While a binaural recording allows a reproduction of all spatial information using only two channels, a stereo recording would not provide the same spatial perception.

Regular dual channel (stereophonic) or multiple channel (e.g. 5.1) recordings may be transformed into binaural recordings by convolving each regular signal with a set of perceptual transfer functions. Such perceptual transfer functions model the influence of the human head, and possibly other objects, on the signal. A well-known type of perceptual transfer function is the so-called Head-Related Transfer Function (HRTF). An alternative type of perceptual transfer function, which also takes into account reflections caused by the walls, ceiling and floor of a room, is the Binaural Room Impulse Response (BRIR).

In the case of multiple channel signals, transforming the signals into binaural recording signals with a set of perceptual functions typically implies a convolution of perceptual functions with the signals of all channels. As a typical convolution is computationally demanding, the signals and the HRTF are typically transformed to the frequency (Fourier) domain where the convolution is replaced with a computationally far less demanding multiplication.

It is further well known to reduce the number of audio channels to be transmitted or stored by representing the original number of channels by a smaller number of channels and parameters indicative of the relationships between the original channels. A set of stereo signals may thus be represented by a single (mono) channel plus a number of associated spatial parameters, while a set of 5.1 signals may be represented by two channels and a set of associated spatial parameters, or even by a single channel plus the associated spatial parameters. This "downmixing" of multiple audio channels in spatial encoders, and the corresponding "upmixing" of audio signals in spatial decoders, is typically carried out in a transform domain or sub-band domain, for example the QMF (Quadrature Mirror Filter) domain.

When downmixed input channels are to be converted into binaural output channels, the Prior Art approach is to first upmix the input channels using a spatial decoder to produce upmixed intermediary channels, and then convert these upmixed intermediary channels into binaural channels. This procedure typically produces five or six intermediary channels, which then have to be reduced to two binaural channels. First expanding and then reducing the number of channels is clearly not efficient and increases the computational complexity. In addition, reducing the five or six intermediary channels meant for multiple channel loudspeaker reproduction to only two channels meant for binaural reproduction inevitably introduces artifacts and therefore decreases the sound quality.

The QMF domain referred to above is similar, but not identical, to the frequency (Fourier transform) domain. If a spatial decoder is to produce binaural output signals, the downmixed audio signals would first have to be transformed to the QMF domain for upmixing, then be inversely QMF transformed to produce time domain intermediary signals, subsequently be transformed to the frequency domain for multiplication with the (Fourier transformed) HRTF, and finally be inversely transformed to produce time domain output signals. It will be clear that this procedure is not efficient, as several transforms must be performed in succession.

The number of computations involved in this Prior Art approach would make it very difficult to design a hand-held consumer device, such as a portable MP3 player, capable of producing binaural output signals from downmixed audio signals. Even if such a device could be implemented, its battery life would be very short due to the required computational load.

It is an object of the present invention to overcome these and other problems of the Prior Art and to provide a spatial decoder unit capable of producing a pair of binaural output channels from a set of downmixed audio channels represented by one or more audio input channels and an associated set of spatial parameters, which decoder has an increased efficiency.

Accordingly, the present invention provides a spatial decoder unit for producing a pair of binaural output channels using spatial parameters and one or more audio input channels, the device comprising a parameter conversion unit for converting the spatial parameters into binaural parameters using parameterized perceptual transfer functions, and a spatial synthesis unit for synthesizing a pair of binaural channels using the binaural parameters and the audio channels.

By converting the spatial parameters into binaural parameters, the spatial synthesis unit can directly synthesize a pair of binaural channels, without requiring an additional binaural synthesis unit. As no superfluous intermediary signals are produced, the computational requirements are reduced while the introduction of artifacts is substantially eliminated.

In the spatial decoder unit of the present invention, the synthesis of the binaural channels can be carried out in the transform domain, for example the QMF domain, without requiring the additional steps of transformation to the frequency domain and the subsequent inverse transformation to the time domain. As two transform steps can be omitted, both the number of computations and the memory requirements are significantly reduced. The spatial decoder unit of the present invention can therefore relatively easily be implemented in a portable consumer device.

Furthermore, in the spatial decoder unit of the present invention, binaural channels are produced directly from downmixed channels, each binaural channel comprising binaural signals for binaural reproduction using a headset or a similar device. The parameter conversion unit derives the binaural parameters used for producing the binaural channels from spatial (that is, upmix) parameters. This derivation of the binaural parameters involves parameterized perceptual transfer functions, such as HRTFs (Head-Related Transfer Functions) and/or Binaural Room Impulse Responses (BRIRs). According to the present invention, therefore, the processing of the perceptual transfer functions is performed in the parameter domain, while in the Prior Art this processing was carried out in the time domain or the frequency domain. This may result in a further reduction of the computational complexity as the resolution in the parameter domain is typically lower than the resolution in the time domain or the frequency domain.

It is preferred that the parameter conversion unit is arranged for combining in the parameter domain, in order to determine the binaural parameters, all perceptual transfer function contributions the input (downmix) audio channels would make to the binaural channels. In other words, the spatial parameters and the parameterized perceptual transfer functions are combined in such a manner that the combined parameters result in a binaural output signal having similar statistical properties to those obtained in the Prior Art method involving upmixed intermediary signals.

In a preferred embodiment, the spatial decoder unit of the present invention further comprises one or more transform units for transforming the audio input channels into transformed audio input channels, and a pair of inverse transform units for inversely transforming the synthesized binaural channels into the pair of binaural output channels, wherein the spatial synthesis unit is arranged for operating in a transform domain or sub-band domain, preferably the QMF domain.

The spatial decoder unit of the present invention may comprise two transform units, the parameter conversion unit being arranged for utilizing perceptual transfer function parameters involving three channels only, two of these three channels incorporating the contributions of composite front and rear channels. In such an embodiment, the parameter conversion unit may be arranged for processing channel level (e.g. CLD), channel coherence (e.g. ICC), channel prediction (e.g. CPC) and/or phase (e.g. IPD) parameters.

In an alternative embodiment, the spatial decoder unit of the present invention may comprise only a single transform unit, and may further comprise a decorrelation unit for decorrelating the transformed single channel output by the single transform unit. In such an embodiment, the parameter conversion unit may be arranged for processing channel level (e.g. CLD), channel coherence (e.g. ICC), and/or phase (e.g. IPD) parameters.

The spatial decoder unit of the present invention may additionally comprise a stereo reverberation unit. Such a stereo reverberation unit may be arranged for operating in the time domain or in a transform domain or sub-band (e.g. QMF) domain.

The present invention also provides a spatial decoder device for producing a pair of binaural output channels from an input bitstream, the device comprising a demultiplexer unit for demultiplexing the input bitstream into at least one downmix channel and signal parameters, a downmix decoder unit for decoding the at least one downmix channel, and a spatial decoder unit for producing a pair of binaural output channels using the spatial parameters and the at least one downmix channel, wherein the spatial decoder unit comprises a parameter conversion unit for converting the spatial parameters into binaural parameters using parameterized perceptual transfer functions, and a spatial synthesis unit for synthesizing a pair of binaural channels using the binaural parameters and the at least one downmix channel.

In addition, the present invention provides a consumer device and an audio system comprising a spatial decoder unit and/or spatial decoder device as defined above. The present invention further provides a method of producing a pair of binaural output channels using spatial parameters and one or more audio input channels, the method comprising the steps of converting the spatial parameters into binaural parameters using parameterized perceptual transfer functions, and synthesizing a pair of binaural channels using the binaural parameters and the audio channels. Further aspects of the method according to the present invention will become apparent from the description below.

The present invention additionally provides a computer program product for carrying out the method as defined above. A computer program product may comprise a set of computer executable instructions stored on a data carrier, such as a CD or a DVD. The set of computer executable instructions, which allow a programmable computer to carry out the method as defined above, may also be available for downloading from a remote server, for example via the Internet.

The present invention will further be explained below with reference to exemplary embodiments illustrated in the accompanying drawings, in which:

FIG. 1 schematically shows the application of head-related transfer functions according to the Prior Art.

Figure 2:
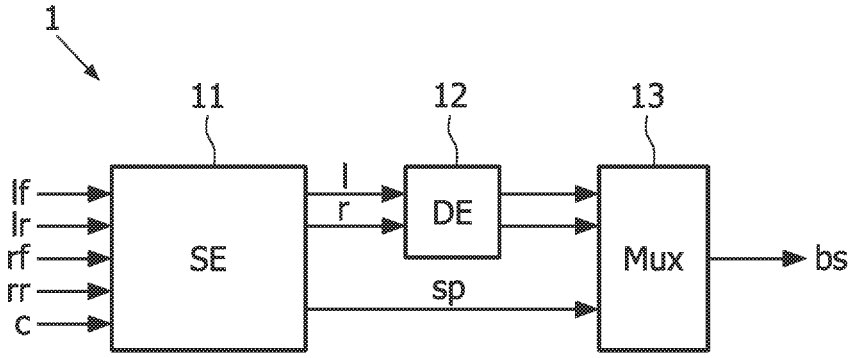
FIG. 2 Prior Art

FIG. 2 schematically shows a spatial audio encoder device according to the Prior Art.

Figure 3:
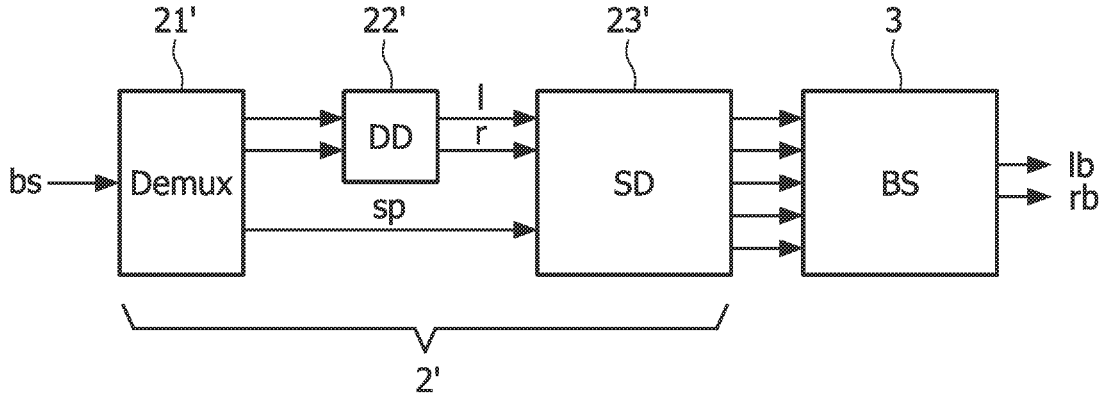
FIG. 3 Prior Art

FIG. 3 schematically shows a spatial audio decoder device according to the Prior Art coupled to a binaural synthesis device.

Figure 4:
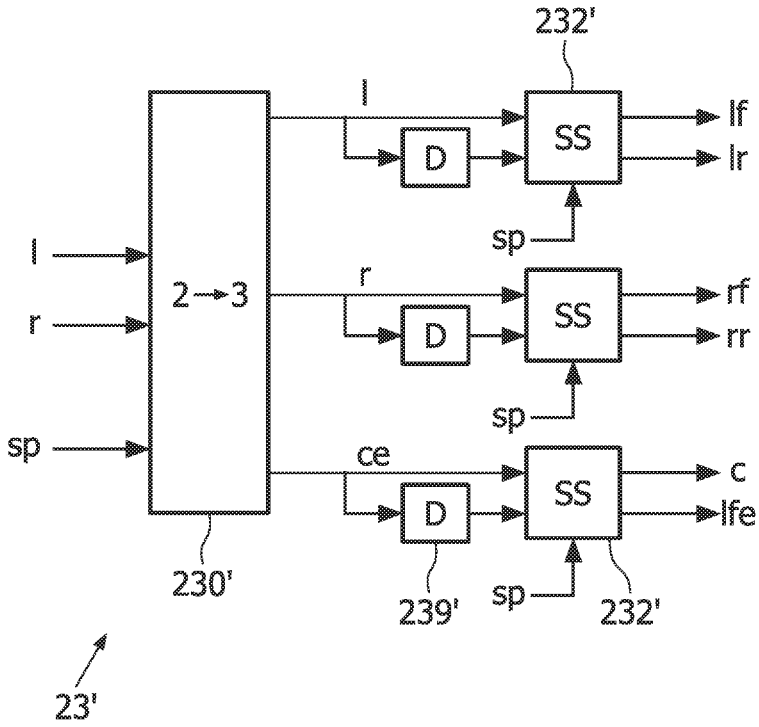
FIG. 4 Prior Art

FIG. 4 schematically shows a spatial audio decoder unit according to the Prior Art.

Figure 5:
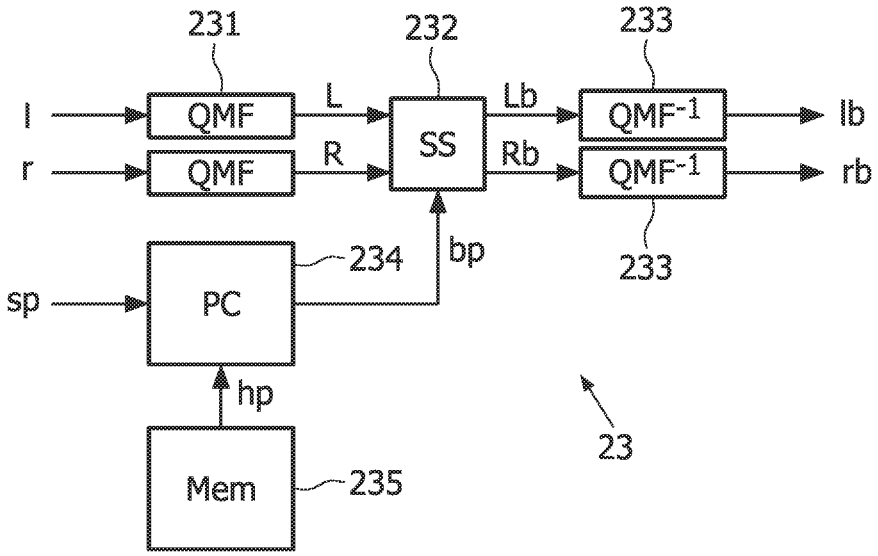

FIG. 5 schematically shows a spatial audio decoder unit according to the present invention.

Figure 6:
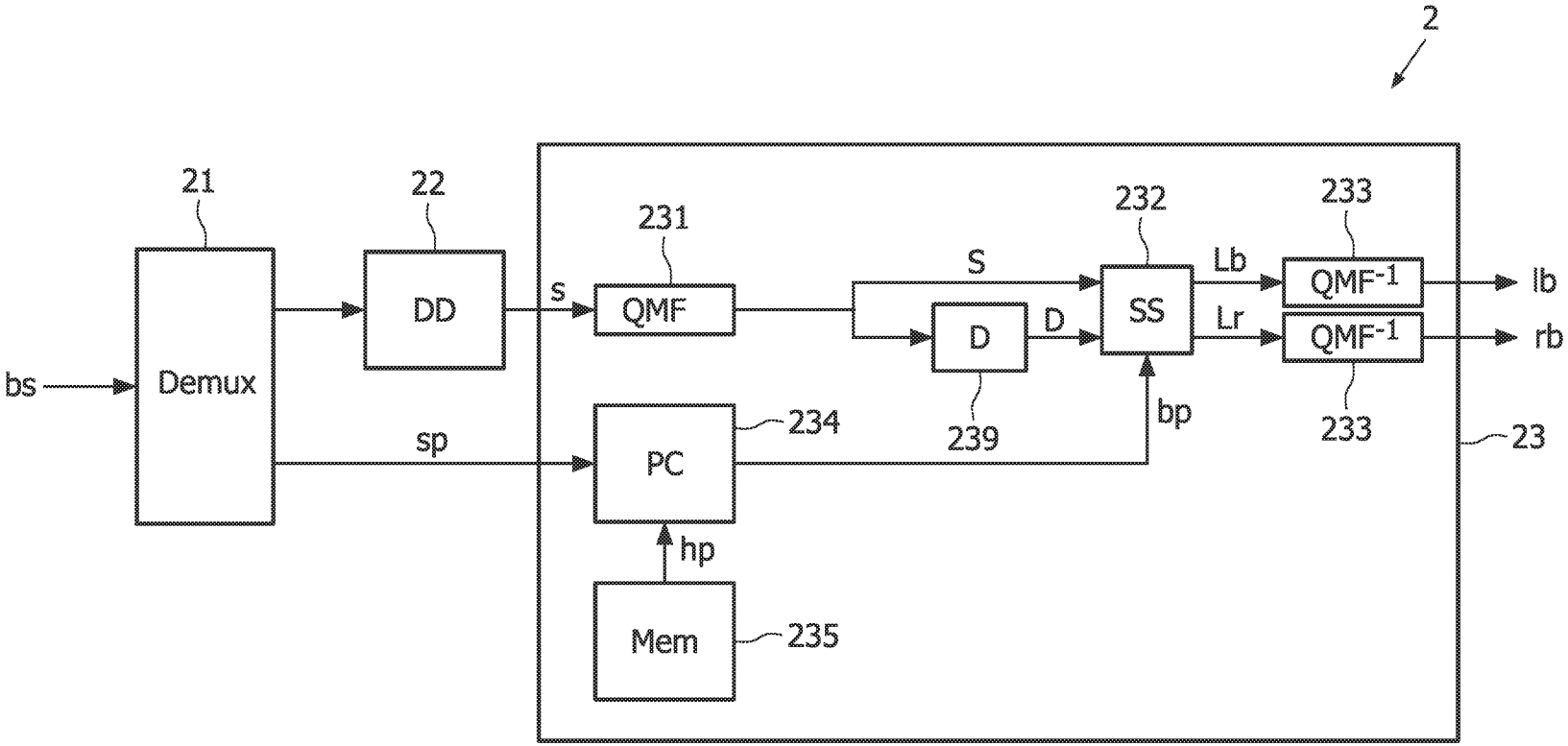

FIG. 6 schematically shows a spatial audio decoder device according to the present invention.

Figure 7:
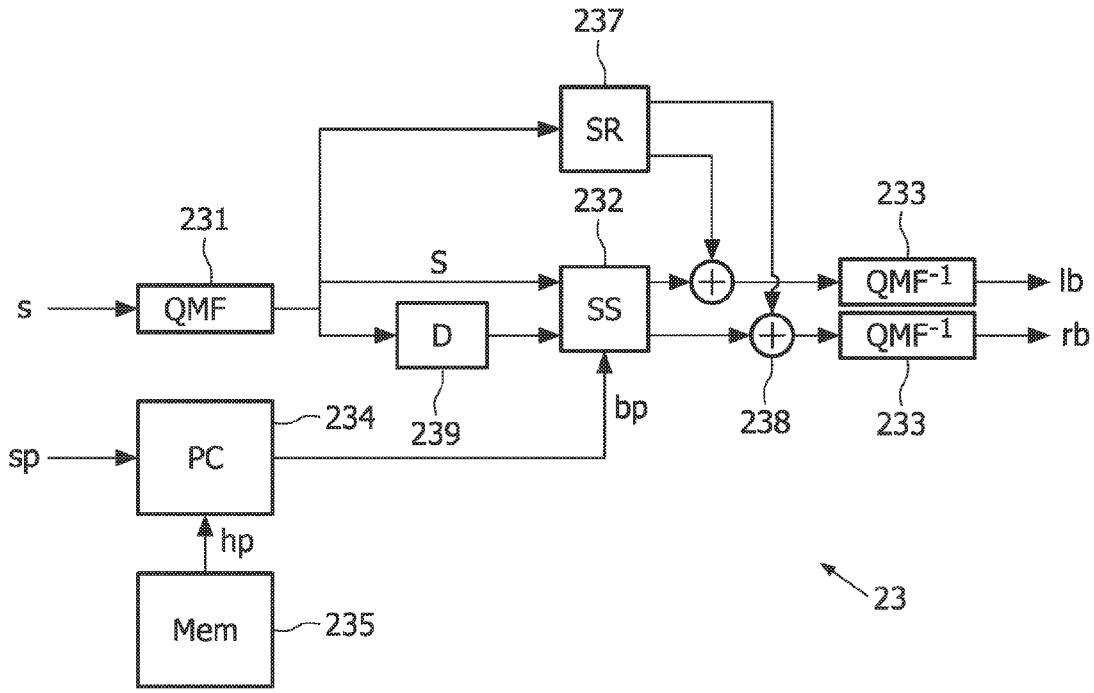

FIG. 7 schematically shows the spatial audio decoder unit of FIG. 5, provided with a transform domain reverberation unit.

Figure 8:
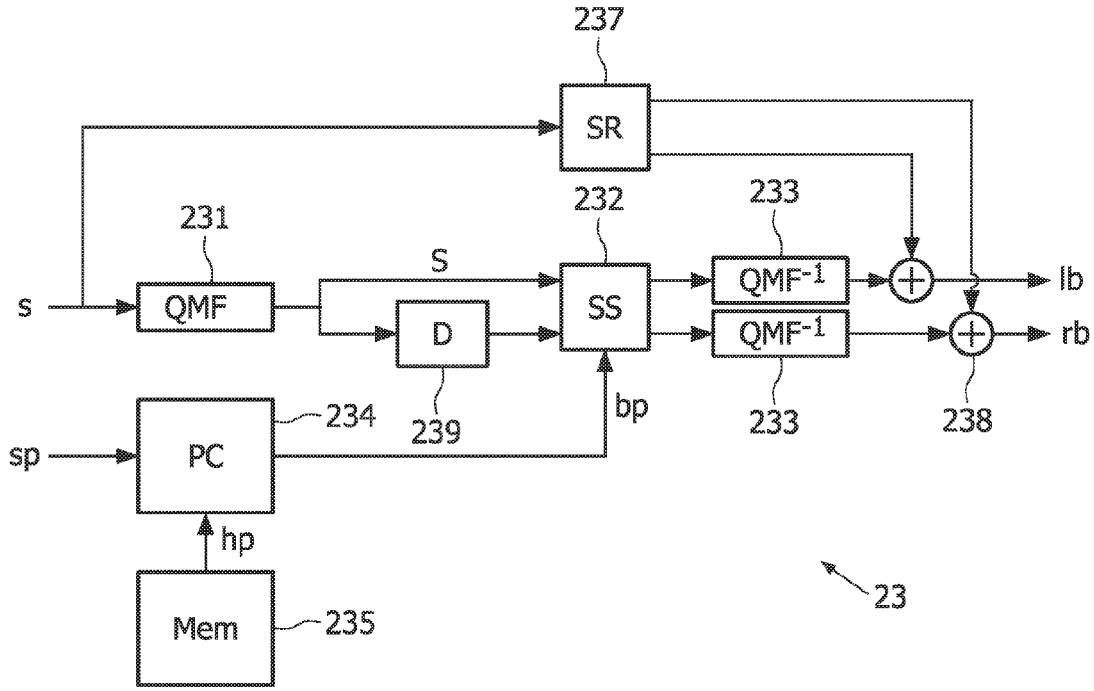

FIG. 8 schematically shows the spatial audio decoder unit of FIG. 5, provided with a time domain reverberation unit.

Figure 9:
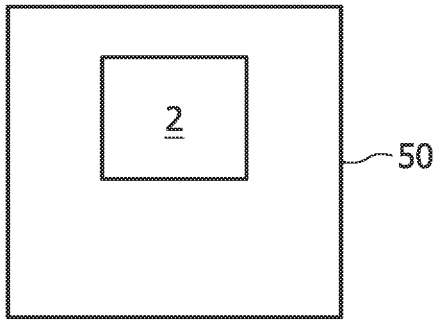

FIG. 9 schematically shows a consumer device provided with a spatial audio decoder device according to the present invention.

The application of perceptual transfer functions, such as Head-Related Transfer Functions (HRTFs), in accordance with the Prior Art is schematically illustrated in FIG. 1. The binaural synthesis device 3 is shown to comprise six HRTF units 31, each containing the transfer function for a specific combination of an input channel and an output channel. In the example shown, there are three audio input channels ch1, ch2 and ch3, which may correspond to the channels l (left), c (center) and r (right). The first channel ch1 is fed to two HRTF units 31 containing HRTF(1,L) and HRTF(1,R) respectively. In this example, HRTF(1,L) is the head-related transfer function which determines the contribution of the first channel to the left binaural signal.

Those skilled in the art will know that HRTFs may be determined by making both regular (stereo) recordings and binaural recordings, and deriving a transfer function which represents the shaping of the binaural recording relative to the regular recording. Binaural recordings are made using two microphones mounted in a dummy human head, so that the recorded sound corresponds to the sound captured by the human ear and includes any influences due to the shape of the head and the ears, and even the presence of hair and shoulders.

If the HRTF processing takes place in the time domain, the HRTFs are convolved with the (time domain) audio signals of the channels. Typically, however, the HRTFs are transformed to the frequency domain, and the resulting transfer functions and the frequency spectra of the audio signals are then multiplied (Fourier transform units and inverse Fourier transform units are not shown in FIG. 1). Suitable Overlap-and-Add (OLA) techniques involving overlapping time frames may be used to accommodate HRTFs having a greater length than the Fast Fourier Transform (FFT) frames.

After HRTF processing by the appropriate HRTF unit 31, the resulting left and right signals are added by a respective adder 32 to yield the (time domain) left binaural signal lb and the right binaural signal rb.

The exemplary Prior Art binaural synthesis device 3 of FIG. 1 has three input channels. Present-day audio systems often have five or six channels, as is the case in so-called 5.1 systems. However, in order to reduce the amount of data to be transferred and/or stored, the multiple audio channels are typically reduced ("downmixed") to one or two channels. A number of signal parameters indicative of the properties and mutual relationships of the original channels allows an expansion ("upmixing") of the one or two channels to the original number of channels. An exemplary spatial encoder device 1 according to the Prior Art is schematically illustrated in FIG. 2.

The spatial encoder device 1 comprises a spatial encoding (SE) unit 11, a downmix encoding (DE) unit 12 and a multiplexer (Mux) 13. The spatial encoding unit 11 receives five audio input channels lf (left front), lr (left rear), rf (right front), rr (right rear) and c (center). The spatial encoding unit 11 downmixes the five input channels to produce two channels l (left) and r (right), as well as signal parameters sp (it is noted that the spatial encoding unit 11 may produce a single channel instead of the two channels l and r). In the embodiment shown, where five channels are downmixed to two channels (a so-called 5-2-5 configuration), the signal parameters sp may for example comprise:

| Parameter | Description |
|---|---|
| $CPC_1$ | Prediction/energy parameter for 2-to-3 conversion |
| $CPC_2$ | Prediction/energy parameter for 2-to-3 conversion |
| $CLD_l$ | Level difference left front vs. left rear |
| $CLD_r$ | Level difference right front vs. right rear |
| $ICC_l$ | Correlation left front vs. left rear |
| $ICC_r$ | Correlation right front vs. right rear |
| $ICC_f$ | Correlation parameter for 2-to-3 conversion |
| $CLD_{lfe}$ | Level difference center vs. lfe (if applicable) |

It is noted that "lfe" is an optional low frequency (subwoofer) channel, and that the "rear" channels are also known as "surround" channels.

The two downmix channels l and r produced by the spatial encoding unit 11 are fed to the downmix encoding (DE) unit 12, which typically uses a type of coding aimed at reducing the amount of data. The thus encoded downmix channels l and r, and the signal parameters sp, are multiplexed by the multiplexer unit 13 to produce an output bit stream bs.

In an alternative embodiment (not shown), five (or six) channels are downmixed to a single (mono) channel (a so-called 5-1-5 configuration), and the signal parameters sp may for example comprise:

| Parameter | Description |
|---|---|
| $CLD_{fs}$ | Level difference front vs. rear |
| $CLD_{fc}$ | Level difference front vs. center |
| $CLD_f$ | Level difference front left vs. front right |
| $CLD_s$ | Level difference left rear vs. right rear |
| $ICC_{fs}$ | Correlation front vs. rear |
| $ICC_{fc}$ | Correlation front vs. center |
| $ICC_f$ | Correlation front left vs. front right |
| $ICC_s$ | Correlation left rear vs. right rear |
| $CLD_{lfe}$ | Level difference center vs. lfe (if applicable) |

In this alternative embodiment the encoded downmix channel s, as well as the signal parameters sp, are also multiplexed by the multiplexer unit 13 to produce an output bit stream bs.

If this bitstream bs were to be used to produce a pair of binaural channels, the Prior Art approach would be to first upmix the two downmix channels l and r (or, alternatively, the single downmix channel) to produce the five or six original channels, and then convert these five or six channels into two binaural channels. An example of this Prior Art approach is illustrated in FIG. 3.

The spatial decoder device 2' according to the Prior Art comprises a demultiplexer (Demux) unit 21', a downmix decoding unit 22', and a spatial decoder unit 23'. A binaural synthesis device 3 is coupled to the spatial decoder unit 23' of the spatial decoder device 2'.

The demultiplexer unit 21' receives a bitstream bs, which may be identical to the bitstream bs of FIG. 2, and outputs signal parameters sp and two encoded downmix channels. The signal parameters sp are sent to the spatial decoder unit 23', while the encoded downmix channels are first decoded by the downmix decoding unit 22' to produce the decoded downmix channels l and r. The spatial decoder unit 23' essentially carries out the inverse operations of the spatial encoding unit 11 in FIG. 2 and outputs five audio channels. These five audio channels are fed to the binaural synthesis device 3, which may have a structure similar to the device 3 of FIG. 1 but with additional HRTF units 31 to accommodate all five channels. As in the example of FIG. 1, the binaural synthesis device 3 outputs two binaural channels lb (left binaural) and rb (right binaural).

An exemplary structure of the spatial decoder unit 23' of the Prior Art is shown in FIG. 4. The unit 23' of FIG. 4 comprises a two-to-three upmix unit 230', three spatial synthesis (SS) units 232' and three decorrelation (D) units 239'. The two-to-three upmix unit 230' receives the downmix channels l & r and the signal parameters sp, and produces three channels l, r and ce. Each of these channels is fed to a decorrelator unit 239' which produces a decorrelated version of the respective channel. Each channel l, r and ce, its respective decorrelated version, and associated signal parameters sp are fed to a respective spatial synthesis (or upmix) unit 232'. The spatial synthesis unit 232' receiving the channel l, for example, outputs the output channels lf (left front) and lr (left rear). The spatial synthesis units 232' typically perform a matrix multiplication, the parameters of the matrix being determined by the signal parameters sp.

It is noted that in the example of FIG. 4 six output channels are produced. In some embodiments, the third decorrelation unit 239' and the third spatial synthesis unit 232' may be omitted, thus producing only five output channels. In all embodiments, however, the spatial synthesis unit 23' of the Prior Art will produce more than two output channels. It is further noted that any (QMF) transform units and inverse (QMF) transform units have been omitted from the merely illustrative example of FIG. 4 for the sake of clarity of the illustration. In actual embodiments the spatial decoding would be carried out in a transform domain, such as the QMF domain.

The configuration of FIG. 3 is not efficient. The spatial decoder device 2' converts two downmix channels (1 and r) into five upmixed (intermediary) channels, while the binaural synthesis device 3 then reduces the five upmixed channels to two binaural channels. In addition, the upmixing in the spatial decoder unit 23' is typically carried out in a sub-band domain, such as the QMF (Quadrature Mirror Filter) domain. However, the binaural synthesis device 3 typically processes signals in the frequency (that is, Fourier transform) domain. As these two domains are not identical, the spatial decoder device 2' first transforms the signals of the downmix channels into the QMF domain, processes the transformed signals, and then transforms the upmixed signals back to the time domain. Subsequently, the binaural synthesis device 3 transforms all (five in the present example) these upmixed signals into the frequency domain, processes the transformed signals, and then transforms the binaural signals back into the time domain. It will be clear that the computational effort involved is considerable, and that a more efficient signal processing is desired, in particular when this processing is to be carried out in a hand-held device.

The present invention provides a far more efficient processing by integrating the binaural synthesis device in the spatial decoder device and effectively carrying out the binaural processing in the parameter. A merely exemplary embodiment of a spatial decoder unit according to the present invention is schematically illustrated in FIG. 5, while a combined spatial and binaural decoder device according to the present invention (referred to as spatial decoder device for the sake of brevity) is illustrated in FIG. 6.

The inventive spatial decoder unit 23 shown merely by way of non-limiting example in FIG. 5 comprises transform units 231, a spatial synthesis (SS) unit 232, inverse transform units 233, a parameter conversion (PC) unit 234 and a memory (Mem) unit 235. In the exemplary embodiment of FIG. 5, the spatial decoder unit 23 comprises two transform units 231, but in alternative embodiments only a single transform unit 231 (as in FIG. 6), or more than two transform units 231 may be present, depending on the number of downmix channels.

The transform units 231 each receive a downmix channel l and r respectively (see also FIG. 3). Each transform unit 231 is arranged for transforming the (signal of the) respective channel into a suitable transform or sub-band domain, in the present example the QMF domain. The QMF transformed channels L and R are fed to the spatial synthesis unit 232 which preferably carries out a matrix operation on the signals of the channels L and R to produce the transform domain binaural channels Lb and Rb. Inverse transform units 233 carry out an inverse transform, in the present example an inverse QMF transform, to produce the binaural time domain channels lb and rb.

The spatial synthesis unit 232 may be similar or identical to the Prior Art spatial synthesis unit 232' of FIG. 4. However, the parameters used by this unit are different from those used in the Prior Art. More in particular, the parameter conversion unit 234 converts the conventional spatial parameters sp into binaural parameters bp using HRTF parameters hp stored in the memory unit 235. These HRTF parameters hp may comprise:

an average level per frequency band for the left transfer function as a function of azimuth (angle in a horizontal plane), elevation (angle in a vertical plane), and distance, an average level per frequency band for the right transfer function as a function of azimuth, elevation and distance, and an average phase or time difference per frequency band as a as a function of azimuth, elevation and distance.

In addition, the following parameters may be included:

a coherence measure of the left and right transfer functions per HRTF frequency band as a function of azimuth, elevation and distance, and/or absolute phase and/or time parameters for the left and right transfer functions as a function of azimuth, elevation and distance.

The actual HRTF parameters used may depend on the particular embodiment.

The spatial synthesis unit 232 may determine the binaural channels Lb and Rb using the following formula:

$$\begin{bmatrix} Lb[k,m] \\ Rb[k,m] \end{bmatrix} = H_k \begin{bmatrix} L[k,m] \\ R[k,m] \end{bmatrix} = \begin{bmatrix} h_{11} & h_{12} \\ h_{21} & h_{22} \end{bmatrix}_k \begin{bmatrix} L[k,m] \\ R[k,m] \end{bmatrix} \tag{1}$$

where the index k denotes the QMF hybrid (frequency) band index and the index m denotes the QMF slot (time) index. The parameters $h_{ij}$ of the matrix $H_k$ are determined by the binaural parameters (bp in FIG. 5). As indicated by the index k, the matrix $H_k$ may depend on the QMF hybrid band. In a first embodiment, the parameter conversion unit (234 in FIG. 5) produces the binaural parameters which are then converted into the matrix parameters $h_{ij}$ by the spatial synthesis unit 232. In a second embodiment, the matrix parameters $h_{ij}$ are identical to the binaural parameters produced by the parameter conversion unit (234 in FIG. 5) and can be directly applied by the spatial synthesis unit 232 without being converted.

The parameters $h_{ij}$ of the matrix $H_k$ may be determined in the following way in the case of two downmix channels (5-2-5 configuration). In the Prior Art spatial decoder unit of FIG. 4, a 2-to-3 decoder unit 230' converts the two (input) downmix channels l and r into three (output) channels l, r, and ce (it will be understood that the output channels l and r will typically not be identical to the input channels l and r, for this reason the input channels will in the following discussion be labeled $l_0$ and $r_0$).

In accordance with a further aspect of the present invention the parameter conversion unit (234 in FIGS. 5 & 6) is arranged for utilizing perceptual transfer function parameters where the contribution of only three channels only (e.g. l, r and c) is taken into account, two of these three channels (e.g. l and r) comprising composite respective front (lf, rf) and rear (lr, rr) channels. That is, the respective front and rear channels are grouped together to improve the efficiency.

The operation of the two-to-three upmix unit 230' can be described by the following matrix operation:

$$\begin{bmatrix} l \\ r \\ c \end{bmatrix} = \begin{bmatrix} m_{11} & m_{12} \\ m_{21} & m_{22} \\ m_{31} & m_{32} \end{bmatrix} \begin{bmatrix} l_0 \\ r_0 \end{bmatrix} \tag{2}$$

with matrix entries $m_{ij}$ dependent on the spatial parameters. The relation of spatial parameters and matrix entries is identical to those of a 5.1 MPEG surround decoder. For each of the three resulting signals l, r and c, the effect is determined of the perceptual transfer function (in the present example: HRTF) parameters which correspond to the desired (perceived) position of these sound sources. For the center channel (c), the spatial parameters of the sound source position can be applied directly, resulting in two output signals for center, $l_B(c)$ and $r_B(c)$:

$$\begin{bmatrix} l_B(c) \\ r_B(c) \end{bmatrix} = \begin{bmatrix} H_l(c) \\ H_r(c) \end{bmatrix} c = \begin{bmatrix} P_l(c)e^{+j\phi(c)/2} \\ P_r(c)e^{-j\phi(c)/2} \end{bmatrix} c \tag{3}$$

As can be observed from equation (3), the HRTF parameter processing consists of a multiplication of the signal with average power levels $P_l$ and $P_r$ corresponding to the sound source position of the center channel, while the phase difference is distributed symmetrically. This process is performed independently for each QMF band, using the mapping from HRTF parameters to QMF filter bank on the one hand, and mapping from spatial parameters to QMF band on the other hand.

For the left (l) channel, the HRTF parameters from the left-front and left-rear channels are combined into a single contribution, using the weights $w_{lf}$ and $w_{rf}$. The resulting composite parameters simulate the effect of both the front and rear channels in a statistical sense. The following equations are used to generate the binaural output pair ($l_b$, $r_b$) for the left channel:

$$\begin{bmatrix} l_b(l) \\ r_b(l) \end{bmatrix} = \begin{bmatrix} H_l(l) \\ H_r(l) \end{bmatrix} l \tag{4}$$

with $$H_l(l) = \sqrt{w_{lf}^2 P_l^2(lf) + w_{lr}^2 P_l^2(lr)} \tag{5}$$

and $$H_r(l) = e^{-j(w_{lf}^2 \phi(lf) + w_{ls}^2 \phi(lr))} \sqrt{w_{lf}^2 P_r^2(lf) + w_{lr}^2 P_r^2(lr)} \tag{6}$$

The weights $w_{lr}$ and $w_{rf}$ depend on the CLD parameter of the 1-to-2 unit for lf and lr:

$$w_{lf}^2 = \frac{10^{CLD_l/10}}{1 + 10^{CLD_l/10}}, \tag{7}$$

$$w_{lr}^2 = \frac{1}{1 + 10^{CLD_l/10}} \tag{8}$$

In a similar fashion, the binaural output for the right channel is obtained according to:

$$\begin{bmatrix} L_b(r) \\ R_b(r) \end{bmatrix} = \begin{bmatrix} H_l(r) \\ H_r(r) \end{bmatrix} r, \tag{9}$$

with $$H_l(r) = e^{+j(w_{rf}^2 \phi(rf) + w_{rs}^2 \phi(rr))} \sqrt{w_{rf}^2 P_l^2(rf) + w_{rr}^2 P_l^2(rs)} \tag{10}$$

$$H_r(r) = \sqrt{w_{rf}^2 P_r^2(rf) + w_{rr}^2 P_r^2(rr)} \tag{11}$$

$$w_{rf}^2 = \frac{10^{CLD_r/10}}{1 + 10^{CLD_r/10}} \tag{12}$$

$$w_{rr}^2 = \frac{1}{1 + 10^{CLD_r/10}}. \tag{13}$$

It is noted that the phase modification term is applied to the contra-lateral ear in both cases. Furthermore, since the human auditory system is largely insensitive to binaural phase for frequencies above approx. 2 kHz, the phase modification term only needs to be applied in the lower frequency region. Hence for the remainder of the frequency range, real-valued processing suffices (assuming real-valued $m_{ij}$).

It is further noted that the equations above assume incoherent addition of the (HRTF) filtered signals of lf and lr. One possible extension would be to include the transmitted Inter-Channel Coherence (ICC) parameters of lf and lr (and of lf and rr) in the equations as well to account for front/rear correlation.

All processing steps described above can be combined in the parameter domain to result in a single, signal-domain 2×2 matrix:

$$\begin{bmatrix} l_b \\ r_b \end{bmatrix} = \begin{bmatrix} h_{11} & h_{12} \\ h_{21} & h_{22} \end{bmatrix} \begin{bmatrix} l_0 \\ r_0 \end{bmatrix}, \tag{14}$$

with $$h_{11} = m_{11} H_l(l) + m_{21} H_l(r) + m_{31} H_l(c) \tag{15a}$$

$$h_{12} = m_{12} H_l(l) + m_{22} H_l(r) + m_{32} H_l(c) \tag{15b}$$

$$h_{21} = m_{11} H_r(l) + m_{21} H_r(r) + m_{31} H_r(c) \tag{15c}$$

$$h_{22} = m_{12} H_r(l) + m_{22} H_r(r) + m_{32} H_r(c). \tag{15d}$$

As will be clear from the above, the present invention essentially processes the binaural (that is, HRTF) information in the parameter domain, instead of in the frequency or time domain as in the Prior Art. In this way, significant computational savings may be obtained.

The spatial decoder device 2 according to the present invention shown merely by way of non-limiting example in FIG. 6 comprises a demultiplexer (Demux) unit 21, a downmix decoding unit 22, and a spatial/binaural decoder unit 23. The demultiplexer unit 21 and the downmix decoding unit 22 may be similar to the Prior Art demultiplexer unit 21' and the downmix decoding unit 22' shown in FIG. 3. The spatial decoder unit 23 of FIG. 6 is identical to the spatial decoder unit 23 of FIG. 5, with the exception of the number of downmix channels and associated transform units. As the spatial decoder device of FIG. 6 is arranged for a single downmix channel s, only a single transform unit 231 is provided while a decorrelation (D) unit 239 has been added for producing a decorrelated version D of the (transform domain) downmix signal S. The binaural parameters bp produced by the parameter conversion unit 234 typically differ from those in the embodiment of FIG. 5, as the signal parameters sp associated with a single downmix channel s typically differ from those associated with two downmix channels.

In the configuration of FIG. 6, the input of the binaural decoder comprises a mono input signal s accompanied by spatial parameters sp. The binaural synthesis unit generates a stereo output signal with statistical properties that approximate those properties that would result from HRTF processing of the original 5.1 input, which can be described by:

$$l_b = H_l(lf) \otimes lf + H_l(rf) \otimes rf + H_l(lr) \otimes lr + H_l(Rr) \otimes Rr + H_l(c) \otimes c \tag{16}$$

$$r_b = H_r(lf) \otimes lf + H_r(rf) \otimes rf + H_r(lr) \otimes lr + H_r(rr) \otimes rr + H_r(c) \otimes c \tag{17}$$

Given the spatial parameters which describe statistical properties and inter-relations of the channels lf, rf, lr, rr and c, and the parameters of the HRTF impulse responses, it is possible to estimate the statistical properties (that is, an approximation of the binaural parameters) of the binaural output pair $l_b$, $r_b$ as well. More specifically, the average energy (for each channel), the average phase difference and the coherence can be estimated and subsequently re-instated by means of decorrelation and matrixing of the mono input signal.

The binaural parameters comprise a (relative) level change for each of the two binaural output channels (and hence define a Channel Level Difference parameter), an (average) phase difference and a coherence measure (per transform domain time/frequency tile).

As a first step, the relative powers (with respect to the power of the mono input signal) of the five (or six) channel (5.1) signal are computed using the transmitted CLD parameters. The relative power of the left-front channel is given by:

$$\sigma_{lf}^2 = r_1(CLD_{fs})r_1(CLD_{fc})r_1(CLD_f), \tag{18}$$

with $$r_1(CLD) = \frac{10^{CLD/10}}{1 + 10^{CLD/10}}, \tag{19}$$

and $$r_2(CLD) = \frac{1}{1 + 10^{CLD/10}}. \tag{20}$$

Similarly, the relative powers of the other channels are given by:

$$\sigma^2_{rf} = r_1(CLD_{fs})r_1(CLD_{fc})r_2(CLD_f) \tag{21a}$$

$$\sigma_c^2 = r_1(CLD_{fs})r_2(CLD_{fc}) \tag{21b}$$

$$\sigma_{ls}^2 = r_2(CLD_{fs})r_1(CLD_s) \tag{21c}$$

$$\sigma_{rs}^2 = r_2(CLD_{fs})r_2(CLD_s) \tag{21d}$$

The expected value of the relative power $\sigma_L^2$ of the left binaural output channel (with respect to the mono input channel), the expected value of the relative power $\sigma_R^2$ of the right binaural output channel, and the expected value of the cross product $L_B R_B^*$ can then be calculated. The coherence of the binaural output ($ICC_B$) is then given by:

$$ICC_B = \frac{|\langle L_B R_B^* \rangle|}{\sigma_L \sigma_R} \tag{22}$$

and the average phase angle ($IPD_B$) is given by:

$$IPD_B = \arg(\langle L_B R_B^* \rangle) \tag{23}$$

The channel level difference ($CLD_B$) of the binaural output is given by:

$$CLD_B = 10\log_{10}\left(\frac{\sigma_L^2}{\sigma_R^2}\right) \tag{24}$$

Finally, the overall (linear) gain of the binaural output compared to the mono input, $g_B$, is given by:

$$g_B\sqrt{\sigma_L^2 + \sigma_R^2} \tag{25}$$

The matrix coefficients required to re-instate the $IPD_B$, $CLD_B$, $ICC_B$ and $g_B$ parameters in the binaural matrix are simply obtained from a conventional parametric stereo decoder, extended with overall gains $g_B$:

$$h_{11} = g_B c_L \cos(\alpha + \beta)\exp(jIPD_B/2) \tag{26a}$$

$$h_{12} = g_B c_L \sin(\alpha + \beta)\exp(jIPD_B/2) \tag{26b}$$

$$h_{21} = g_B c_R \cos(-\alpha + \beta)\exp(-jIPD_B/2) \tag{26c}$$

$$h_{22} = g_B c_R \sin(-\alpha + \beta)\exp(-jIPD_B/2) \tag{26d}$$

with $$\alpha = 0.5 \arccos(ICC_B) \tag{27}$$

$$\beta = \arctan\left(\frac{c_R - c_L}{c_R + c_L}\tan(\alpha)\right) \tag{28}$$

-continued $$c_L = \sqrt{\frac{10^{CLD_B/10}}{1 + 10^{CLD_B/10}}} \tag{29}$$

$$c_R = \sqrt{\frac{1}{1 + 10^{CLD_B/10}}} \tag{30}$$

Further embodiments of the spatial decoder unit of the present invention may contain a reverberation unit. It has been found that adding reverberation improves the perceived distance when binaural sound is produced. For this reason, the spatial decoder unit 23 of FIG. 7 is provided with a stereo reverberation unit 237 connected in parallel with the spatial synthesis unit 232. The stereo reverberation unit 237 of FIG. 7 receives the QMF transform domain single downmix signal S and outputs two reverberation signals, which are added to the transform domain binaural signals (channels Lb and Lr in FIG. 6) by addition units 238. The combined signals are then inversely transformed by inverse transform units 233 before being output.

In the embodiment of FIG. 8, the stereo reverberation unit 237 is arranged for producing a reverberation in the time domain and receives the time domain single downmix signal s. The stereo reverberation unit 237 outputs time domain reverberation signals, which are added to the time domain signals of the binaural channels lb and rb by the addition units 238. Either embodiment provides a suitable reverberation.

The present invention additionally provides a consumer device, such as a hand-held consumer device, and an audio system comprising a spatial decoder unit or spatial decoder device as defined above. The hand-held consumer device may be constituted by an MP3 player or similar device. A consumer device is schematically illustrated in FIG. 9. The consumer device 50 is shown to comprise a spatial decoder device 2 according to the present invention (see FIG. 6).

The present invention is based upon the insight that the computational complexity of a combined spatial decoder device and a binaural synthesis device may be significantly reduced by modifying the spatial parameters in accordance with the binaural information. This allows the spatial decoder device to carry out spatial decoding and perceptual transfer function processing effectively in the same signal processing operation, while avoiding the introduction of any artifacts.

It is noted that any terms used in this document should not be construed so as to limit the scope of the present invention. In particular, the words "comprise(s)" and "comprising" are not meant to exclude any elements not specifically stated. Single (circuit) elements may be substituted with multiple (circuit) elements or with their equivalents.

It will be understood by those skilled in the art that the present invention is not limited to the embodiments illustrated above and that many modifications and additions may be made without departing from the scope of the invention as defined in the appending claims.

The invention claimed is:

1. A spatial decoder for producing a pair of binaural output channels (lb, rb) using spatial parameters (sp) and a single audio input channel (s), said spatial decoder comprising:

a parameter conversion unit for converting the spatial parameters (sp) into binaural parameters (bp) using parametrized perceptual transfer functions (hp), the binaural parameters depending on both the spatial parameters and the parametrized perceptual transfer functions;

a single transform unit for transforming the single audio input channel (s) into a transformed audio channel (S);

a decorrelation unit for decorrelating the transformed audio channel (S) to generate a transformed decorrelated signal (D);

a spatial synthesis unit for synthesizing a pair of transformed binaural channels (Lb, Rb) by applying the binaural parameters (bp) to the transformed audio channel (S) and the transformed decorrelated signal (D); and a pair of inverse transform units for inversely transforming the transformed binaural channels (Lb, Rb) into the pair of binaural output channels (lb, rb).

2. The spatial decoder according to claim 1 where the parameter conversion unit is arranged for combining in the parameter domain, in order to determine the binaural parameters, perceptual transfer function contributions that the audio input channels would make to the binaural channels.

3. The spatial decoder according to claim 1 where the parameter conversion unit is arranged for processing channel level (CLD), channel coherence (ICC) and/or phase (IPD) parameters.

4. The spatial decoder according to claim 1 comprising a stereo reverberation unit arranged for operating in the time domain.

5. The spatial decoder according to claim 1 comprising a stereo reverberation unit arranged for operating in a transform domain or sub-band domain.

6. The spatial decoder according to claim 1 where the parameter conversion unit is adapted to:

determine relative powers for a plurality of virtual audio channels in response to the spatial parameters (sp) and the single audio input channel (s);

estimate statistical properties of the binaural output channels (lb, rb) in response to the determined relative powers for the plurality of virtual audio channels; and determine the binaural parameters (bp) in response to the estimated statistical properties of the binaural output channels (lb, rb).

7. The spatial decoder according to claim 6 where the estimated statistical properties comprise an average energy of the transformed binaural channels (Lb, Rb), an average phase difference of the transformed binaural channels (Lb, Rb) and a coherence of the transformed binaural channels (Lb, Rb).

8. A spatial decoder for producing a pair of binaural output channels (lb, rb) from an input bitstream (bs), said spatial decoder comprising:

a demultiplexer unit for demultiplexing the input bitstream into a single downmix audio input channel (s) and spatial parameters (sp);

a downmix decoder unit for decoding the single downmix channel (s);

a parameter conversion unit for converting the spatial parameters (sp) into binaural parameters (bp) using parametrized perceptual transfer functions (hp), the binaural parameters depending on both the spatial parameters and the parametrized perceptual transfer functions;

a single transform unit for transforming the single downmix audio input channel (s) into a transformed audio channel (S);

a decorrelation unit for decorrelating the transformed audio channel (S) to generate a transformed decorrelated signal (D);

a spatial synthesis unit for synthesizing a pair of transformed binaural channels (Lb, Rb) by applying the binaural parameters (bp) to the transformed audio channel (S) and the transformed decorrelated signal (D); and a pair of inverse transform units for inversely transforming the transformed binaural channels (Lb, Rb) into the pair of binaural output channels (lb, rb).

9. The spatial decoder according to claim 8 said spatial decoder including a reverberation unit.

10. An audio system comprising a spatial decoder for producing a pair of binaural output channels (lb, rb) using spatial parameters (sp) and a single audio input channel (s), said spatial decoder comprising:

a parameter conversion unit for converting the spatial parameters (sp) into binaural parameters (bp) using parametrized perceptual transfer functions (hp), the binaural parameters depending on both the spatial parameters and the parametrized perceptual transfer functions;

a single transform unit for transforming the single audio input channel (s) into a transformed audio channel (S);

a decorrelation unit for decorrelating the transformed audio channel (S) to generate a transformed decorrelated signal (D);

a spatial synthesis unit for synthesizing a pair of transformed binaural channels (Lb, Rb) by applying the binaural parameters (bp) to the transformed audio channel (S) and the transformed decorrelated signal (D); and a pair of inverse transform units for inversely transforming the transformed binaural channels (Lb, Rb) into the pair of binaural output channels (lb, rb).

11. A consumer device comprising a spatial decoder for producing a pair of binaural output channels (lb, rb) using spatial parameters (sp) and a single audio input channel (s), said spatial decoder comprising:

a parameter conversion unit for converting the spatial parameters (sp) into binaural parameters (bp) using parametrized perceptual transfer functions (hp), the binaural parameters depending on both the spatial parameters and the parametrized perceptual transfer functions;

a single transform unit for transforming the single audio input channel (s) into a transformed audio channel (S);

a decorrelation unit for decorrelating the transformed audio channel (S) to generate a transformed decorrelated signal (D);

a spatial synthesis unit for synthesizing a pair of transformed binaural channels (Lb, Rb) by applying the binaural parameters (bp) to the transformed audio channel (S) and the transformed decorrelated signal (D); and a pair of inverse transform units for inversely transforming the transformed binaural channels (Lb, Rb) into the pair of binaural output channels (lb, rb).

12. A method of producing a pair of binaural output channels (lb, rb) using spatial parameters (sp) and a single audio input channel (s), the method comprising the steps of:

converting the spatial parameters (sp) into binaural parameters (bp) using parameterized perceptual transfer functions (hp), the binaural parameters depending on both the spatial parameters and the parametrized perceptual transfer functions;

transforming the single audio input channel (s) into a transformed audio channel (S);

decorrelating the transformed audio channel (S) to generate a transformed decorrelated signal (D);

synthesizing a pair of transformed binaural channels (Lb, Rb) by applying the binaural parameters (bp) to the transformed audio channel (S) and the transformed decorrelated signal (D); and inversely transforming the transformed binaural channels (Lb, Rb) into the pair of binaural output channels (lb, rb).

13. A computer program embodied in a non-transitory computer-readable medium for producing a pair of binaural output channels (lb, rb) using spatial parameters (sp) and a single audio input channel (s), the method comprising the steps of:

converting the spatial parameters (sp) into binaural parameters (bp) using parameterized perceptual transfer functions (hp), the binaural parameters depending on both the spatial parameters and the parametrized perceptual transfer functions;

transforming the single audio input channel (s) into a transformed audio channel (S);

decorrelating the transformed audio channel (S) to generate a transformed decorrelated signal (D);

synthesizing a pair of transformed binaural channels (Lb, Rb) by applying the binaural parameters (bp) to the transformed audio channel (S) and the transformed decorrelated signal (D); and inversely transforming the transformed binaural channels (Lb, Rb) into the pair of binaural output channels (lb, rb).

14. The spatial decoder according to claim 5 where the stereo reverberation unit is adapted for operating in the QMF domain.

* * * * *